US006406096B1

(12) United States Patent
Barile, Sr.

(10) Patent No.: US 6,406,096 B1
(45) Date of Patent: Jun. 18, 2002

(54) SEAT SPRING SYSTEM

(75) Inventor: Peter Barile, Sr., Morristown, TN (US)

(73) Assignee: Shelby Williams Industries, Inc., Morristown, TN (US)

( * ) Notice: Subject to any disclaimer, the term of this patent is extended or adjusted under 35 U.S.C. 154(b) by 0 days.

(21) Appl. No.: 09/540,908

(22) Filed: Mar. 31, 2000

(51) Int. Cl.[7] ..... A47C 1/024

(52) U.S. Cl. ..... 297/301.3; 297/296; 297/299; 297/301.5; 297/301.6; 297/301.7; 297/303.1

(58) Field of Search ..... 297/301.3, 296, 297/299, 301.5, 301.6, 303.1, 301.7

(56) References Cited

U.S. PATENT DOCUMENTS

| | | | | | |
|---|---|---|---|---|---|
| 4,580,836 | A | * | 4/1986 | Verney | 297/296 |
| 4,603,904 | A | | 8/1986 | Tolleson et al. | |
| 4,869,552 | A | | 9/1989 | Tolleson et al. | |
| 4,938,532 | A | * | 7/1990 | Burgess | 297/301.3 |
| 5,039,163 | A | | 8/1991 | Tolleson | |
| 5,887,946 | A | * | 3/1999 | Raftery | 297/299 X |
| 5,902,012 | A | * | 5/1999 | Han | 297/296 X |
| 5,904,397 | A | * | 5/1999 | Fismen | 297/296 X |

* cited by examiner

*Primary Examiner*—Peter M. Cuomo
*Assistant Examiner*—Joseph Edell
(74) *Attorney, Agent, or Firm*—Pitts & Brittian, P.C.

(57) ABSTRACT

A chair including a seat assembly having an improved seat spring system to provide a flexible spring backrest frame. A pair of ends of spaced apart backrest frame members are arranged in registry with respective ends of seat support frame members, with each end positioned in spaced apart alignment across a gap from the respective end of each frame member. An elongated shaped flexible spring element spans each gap, with each spring element having opposed ends being extended a distance along each frame member from the gap. Each opposed end is restrained by a first and a second elongated U-shaped holder receptor paired and separately attachable to each opposed end of the spring element. Each holder receptor includes an opening end being faced towards and in alignment with the second holder opening end. The spring element is positioned between each opening end in side-by-side orientation beside the frame members, providing controlled angular range of motion of the backrest frame when moved by a chair occupant. The spring element is constrained from excessive flex by each holder receptor having projection ends that contact each other proximate a mid-point of the spring element to limit range of motion. The seat spring system includes few parts of low-cost materials that are accessible for adjustments by being exterior to the chair frame while controlling the range of motion of the chair backrest.

20 Claims, 7 Drawing Sheets

SEAT SPRING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Invention

This invention relates generally to the field of movable seating, and more particularly to chairs that are self-adjustable in seat back rest angle during use.

2. Description of Related Art

Prior movable chairs having adjustable backrest frames have provided frame members with internal springs or externally connected spring members to control movement of the backrest frames. A typical flexible backrest is described in U.S. Pat. No. 5,039,163, issued to Tolleson, which discloses a chair including depending leg members and a hollow support frame having at least two open ends terminating beneath the seat assembly of the chair. The chair includes a flexible backrest assembly including a pair of hollow backrest frame members having at least two open frame ends extending downward and beneath the seat assembly. Each open end of the hollow backrest frame contains at least one flexible spring member inserted therein the hollow backrest frame, the spring member composed of a resilient, generally narrow material of rectangular cross-section, with each end of each spring member enclosed by a U-shaped bracket of light weight metal. Each open frame end is aligned with an opposing open end of the tubular seat frame. The U-shaped bracket on each end of each spring member inserts respectively into the open frame end, and the open end of the seat frame. Two spring members and four U-shaped brackets are required for one set of flexible connections of the backrest frame and the seat frame. Additionally, a second set of spring members and U-shaped brackets are required to be positioned interior and alongside each first set of two spring members and four U-shaped brackets inside the backrest frame and the seat frame. The second set of spring members have additional U-shaped brackets enclosing each end of each spring member, with the U-shaped brackets enclosed by sections of hollow support tubes, which are mounted alongside each open end of the backrest frame and the seat frame. Therefore, the flexible backrest assembly requires four spring members, eight U-shaped brackets of a specific size and length, and two additional hollow support tubes mounted alongside each open end of the hollow backrest frame member and the hollow seat frame member. Each spring member is permanently affixed at the opposed ends in place within each U-shaped bracket with rivets to restrain the opposed ends within each bracket while allowing the middle section of each spring member to flex. Each U-shaped bracket includes an exposed flange end that contacts an opposed flange end of an adjacent U-shaped bracket to limit the flex of each spring member and to limit the angular movement of the upper backrest portion of the backrest frame.

U.S. Pat. No. 4,869,552, issued to Tolleson et al., discloses a chair including a seat backrest upstanding frame and a lower backrest part with hollow ends. The hollow ends include depending members aligned with the hollow upstanding frame ends, with a flexible, elongated, flat or blade spring member having opposite ends secured into the center of two opposing holder members for insertion in a concentric orientation into each respective hollow end of the depending members. The open ends of each holder member have stop flange formations that protrude outwardly thereon and are spaced apart from the respective opposite stop flange formations on an adjacent holder member. The stop flanges limit the angle of flexure of the spring member by engagement of the flanges. The depending members require at least two spring members for the lower backrest, require at least two holder members for each spring member, and require an exterior flexible cover to minimize the pinching of a user by the movement of the stop flanges together.

U.S. Pat. No. 4,603,904, issued to Tolleson et al., discloses a seat frame including an upper backrest part and a lower backrest part, each having hollow ends. Each hollow end includes an inserted strut being connected to a pair of spaced apart depending members. A flexible, elongated, cylindrical spring member such as a cable is secured into the center of two opposing depending members which hold the ends of the spring member and which are inserted in a concentric orientation into each respective hollow end of the upper backrest part and the lower backrest part. The depending members require at least two spring members such as lengths of cables for insertion into each upper and lower backrest part of the backrest, require at least two holder members for each spring member, and require an exterior flexible cover to minimize the pinching of a user by the movement of the strut and depending members during flexure of the cylindrical spring member.

The prior adjustable seat support frames are generally frames having a plurality of spring elements within tubular frames underneath the seat cushion frame, or spring members inserted concentrically within the support frames between upper backrest portions and lower backrest portions. Each spring element or spring member is flexible but is surrounded by stop members or flanges for limiting flex over a preferred angle of flexure when a user is seated and applies weight against the backrest. Multiple depending members and enclosing brackets are required to support the spring elements and to provide adequate structural support for each portion of the backrest. There is a need for an improved seat spring system that maintains sufficient tension to limit the angle of flexure for a backrest while minimizing the required parts for proper operation. There is also a need to provide an improved seat spring system that reduces the manufacturing costs for the materials utilized to make the spring elements and to support the spring elements.

Therefore, it is an object of the present invention to provide a chair having an improved seat spring system that provides a resiliently flexible spring backrest having controlled angular range of motion of the chair backrest frame.

It is another object of the present invention to provide a chair having an improved seat system that includes a minimum of parts to reduce production costs and assembly time.

It is another object of the present invention to provide a chair having an improved seat spring system that includes a minimum of spring elements, enclosing tubes, and holder brackets.

It is another object of the present invention to provide a chair having an improved seat spring system including a spring element that is contained by one holder bracket at each end of the spring element, with each holder bracket directly connected to separate members of the chair frame.

It is another object of the present invention to provide a pair of holder brackets enclosing one spring element, with each holder bracket having an inherent angled flange oriented to control the angular range of motion of the spring element.

BRIEF SUMMARY OF INVENTION

Other subjects and advantages will be accomplished by the present invention which includes an improved seat spring system for a portable chair. The chair includes a seat assembly which includes depending leg members and a support frame including a seat support frame having a pair of seat support frame members, each having ends being directed toward the rear of the chair, and a backrest frame having a pair of spaced apart backrest frame members upstanding relative to the pair of seat support frame members. The backrest frame members include ends extending beneath the seat support frame and arranged in registry with respective ends of the seat support frame members, the ends of the backrest frame members are positioned in spaced apart alignment across a gap between each end of the backrest frame member and the respective end of each seat support frame member.

The chair includes a seat spring system for providing a flexible spring backrest for the chair. The seat spring system includes a spring element being shaped and sized for being positioned adjacent the gap between each backrest frame member and each respective seat support frame member. The spring element includes a mid-section being aligned beside the gap, with the spring element having opposed ends being extended a selected distance along either frame member at each gap.

A first holder receptor and a second holder receptor are paired and separately attachable to each opposed end of the spring element. The first and second holder receptors being elongated, having a planar top portion, a planar bottom portion, a closed end, and being substantially U-shaped in cross-section. The first holder receptor includes an opening end being faced towards and in registry alignment with the second holder having an opening end, and each holder receptor having the closed end opposite the opening end. Each holder receptor opening end is positioned apart from a selected space from the other holder receptor opening end, with the selected space being positioned adjacent and to the side of each respective gap. The spring element is positioned therebetween the opening ends of each aligned holder receptor. The spring element mid-section is oriented in side-by-side configuration beside the gap between the frame members. The first holder receptor closed end is secured to an inwards faced side of the backrest frame member, and the second holder receptor closed end is secured to an inwards faced side of the seat support frame member. Therefore, the spring element is positioned essentially off-center relative to the longitudinal center line of each aligned backrest frame member and seat support frame member. The spring element and attached holder receptors are installed adjacent to, and not within, the aligned seat support frame and the backrest frame.

With the spring element mid-section being positioned adjacent the gap in the side-by-side configuration, the spring element provides controlled angular range of motion of the backrest frame when moved by the chair occupant relative to the seat support frame. The spring element concurrently provides structural continuity between each aligned backrest frame member and seat support frame member while the spring element is constrained from excessive flex by each respective first holder receptor and second holder receptor aligned beside the aligned seat support frame and the backrest frame. The material of the spring element is capable of repetitive flexing and being returned to the non-flexed position.

The holder receptors are elongated and include a single layer wall being substantially U-shaped in cross-section. The U-shaped holder receptors provide for restrained enclosure of each respective opposed end of the spring element. Each receptor having an opening defined by a first projection end and an adjacent second end of each receptor, the opening of each receptor being designed to removably receive one each of the opposed ends of the spring element, the opening of the first receptor being faced toward the opening of the second receptor. The first receptor having a first closed end opposite the first projection end and the second end, the second receptor having a second closed end opposite the first projection end and the second end of the second receptor, each opposed end of the spring element being positioned respectively internal of the first closed end and internal of the second closed end of the first receptor and the second receptor. The first receptor is connected in side-by-side configuration along the chair interior of one of the backrest frame members, with the second receptor connected in side-by-side configuration along the respective aligned seat support frame member. With the spring element positioned within each single layer walled, U-shaped holder receptor, each spring element can be independently replaced by removing each restraining a connector and inserting a spring element of similar shape but with more, or less, rigidity for preferential control of the angular range of motion of the backrest frame.

BRIEF DESCRIPTION OF SEVERAL VIEWS OF THE DRAWINGS

The above mentioned features of the invention will become more clearly understood from the following detailed description of the invention contained herein, read together with the drawings in which.

DETAILED DESCRIPTION OF THE INVENTION

Figure 1:
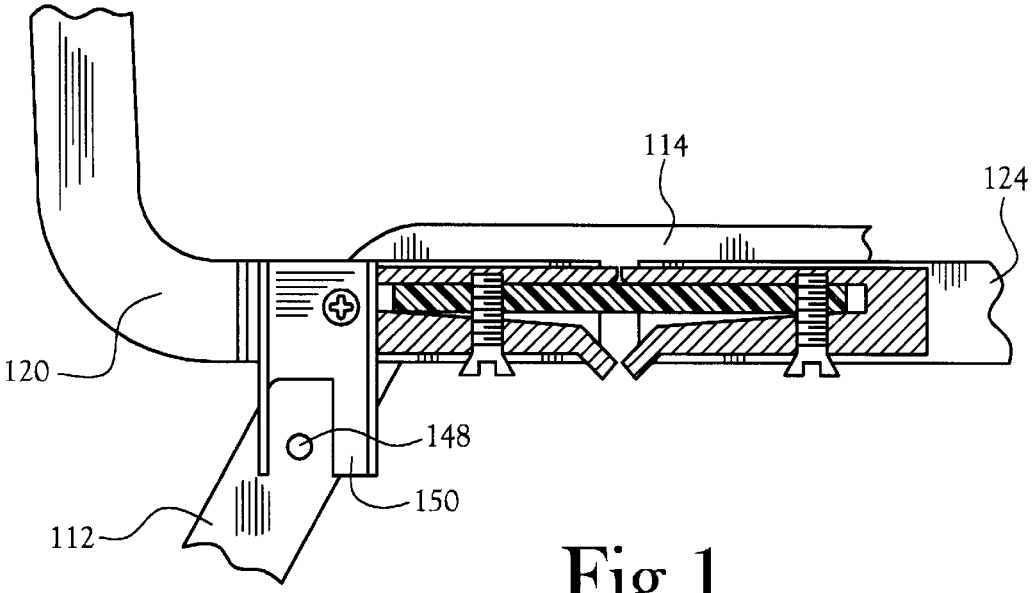
FIG. 1 is a side view of one embodiment of a chair illustrating the seat spring system in accordance with the present invention.
Figure 2:
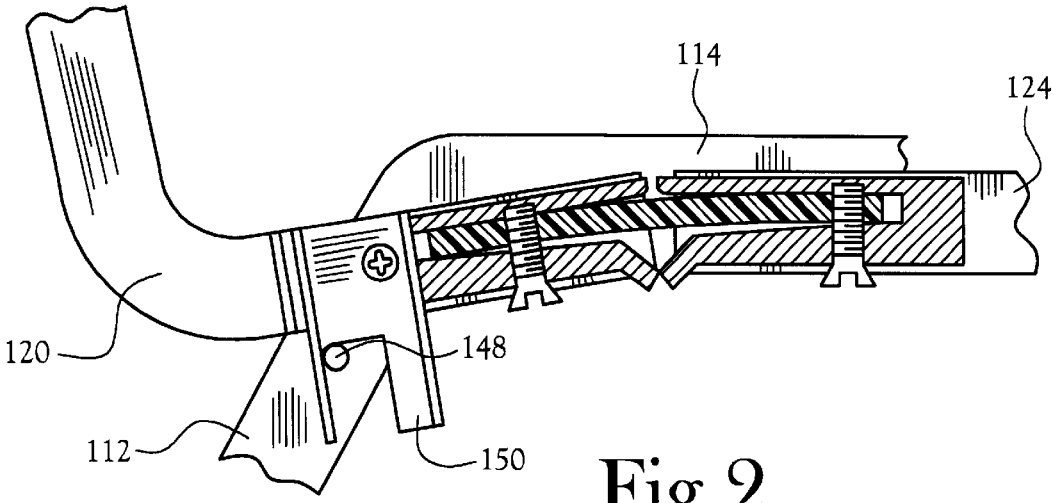
FIG. 2 is a side view of chair of FIG. 1, illustrating the seat spring system in a flexed position.
Figure 3:
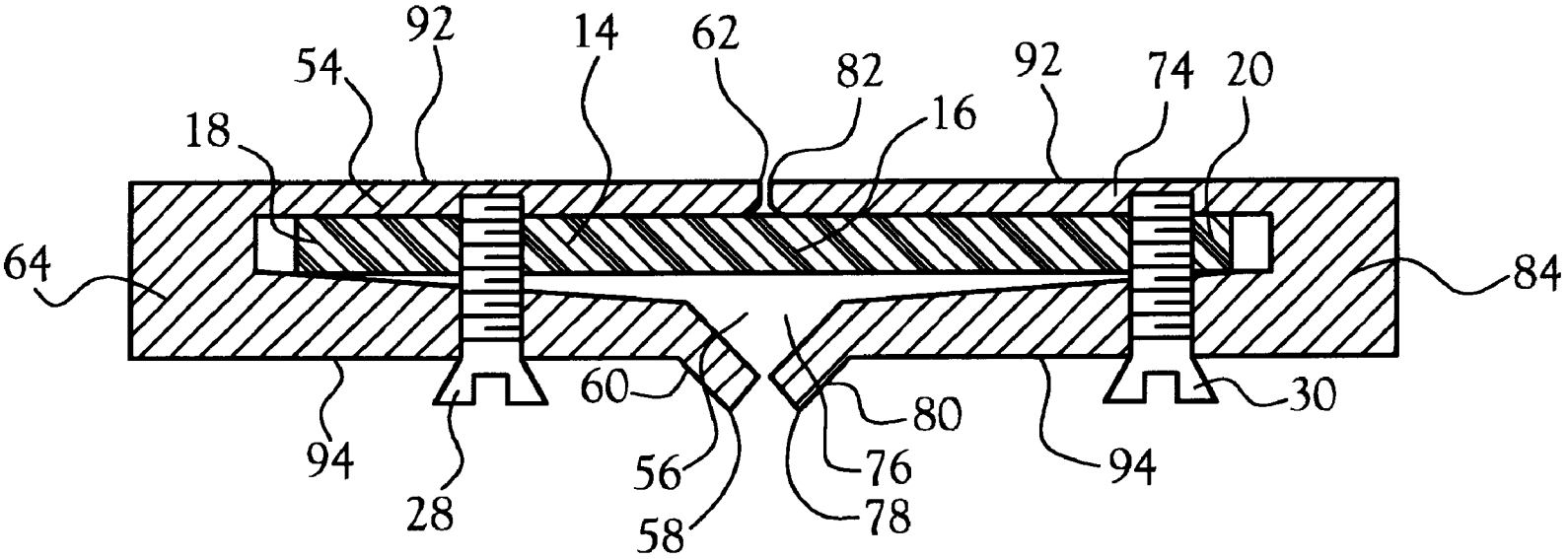
FIG. 3 is a detailed side view of the seat spring system of FIG. 1.
Figure 4:
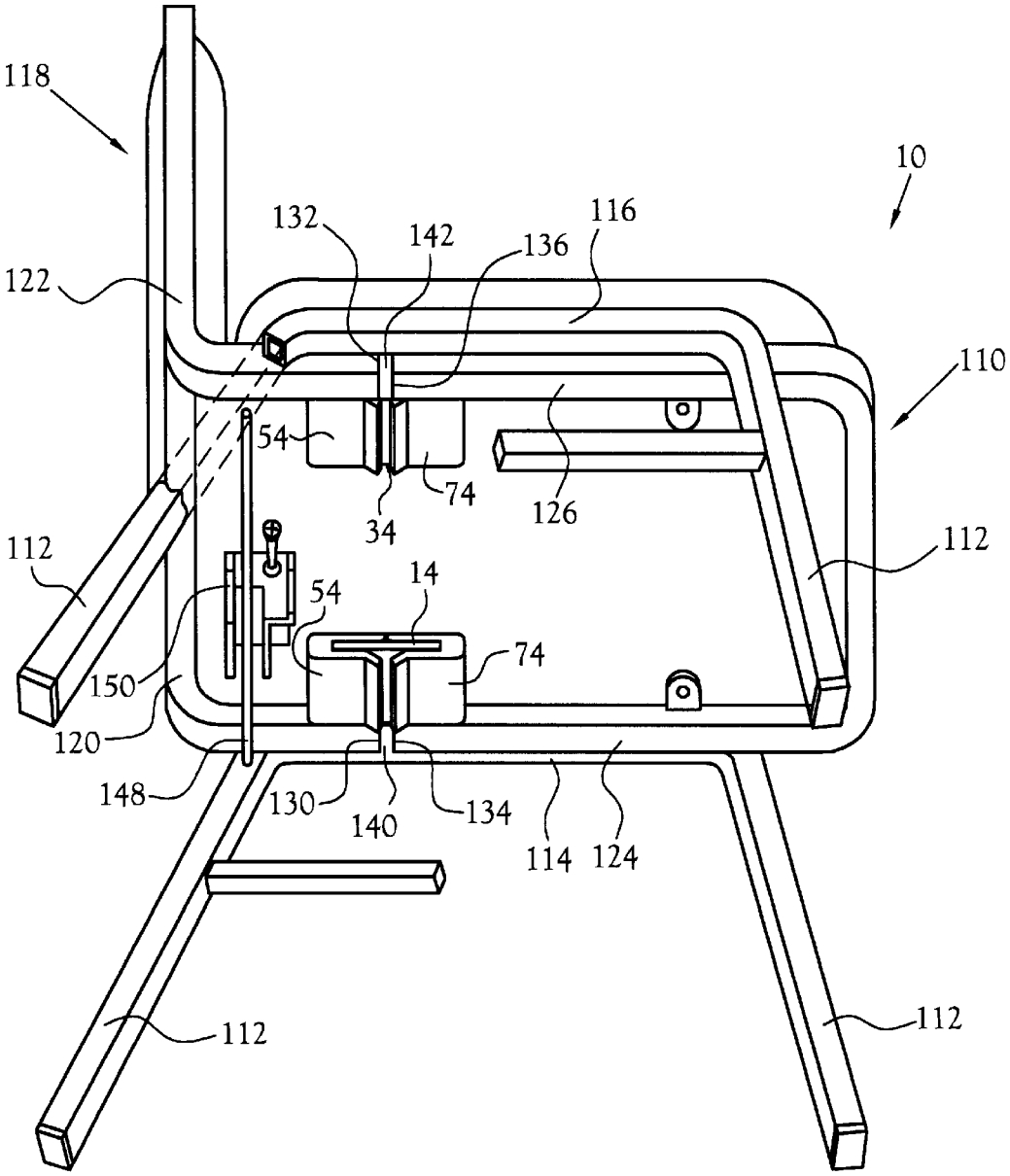
FIG. 4 is an underside perspective view of the chair including the seat spring assembly, illustrating one embodiment of the positioning of a pair of seat spring systems in relation to the backrest frame and seat support frame.

An improved seat spring system is disclosed incorporating various features of the present invention as illustrated generally for a chair at 10 in FIGS. 1–6. FIG. 7 is a side view of a prior art device for a flexible backrest assembly. The improved chair 10 of the present invention is designed to provide for an articulated, flexible spring backrest for a chair having a seat spring system 12 (see FIGS. 1–2). As illustrated in FIGS. 3 and 4, a typical chair 10 with which the seat spring system 12 is incorporated includes a seat assembly 110 which includes depending leg members 112 and a pair of seat side support frame members 114 to which each pair of leg members 112 are attached. The seat assembly includes a seat support frame 116 having a pair of seat support frame members 124, 126, each having ends 134, 136 being directed toward the rear of the chair 10.

The seat support frame 116 is connected to a backrest frame 118 having a pair of spaced apart backrest frame members, first backrest frame member 120 and second backrest frame member 122, both upstanding relative to the pair of seat support frame members 124, 126. The backrest frame members 120, 122 include two ends, end one 130 for frame member 120, and end two 132 for frame member 122, each end extending beneath the seat support frame 116 at a rearward portion of the seat support frame 116. The end 130 and end 132 are arranged in aligned registry with each respective end 134, 136 of each seat support frame members 124, 126.

The ends 130, 132 of the backrest frame members 120, 122 are positioned respectfully in spaced apart alignment across a first side gap 140 between ends 130, 134, and second side gap 142 between ends 132, 136 of the respective frame members for each first and second side of the seat assembly 110. Each of the ends of each frame member can be open, with each frame member being tubular having a generally square cross-section in one embodiment of the present invention.

As illustrated in FIGS. 1 and 2, the chair includes a seat spring system 12 for providing a flexible spring backrest for the chair 10. The seat spring system 12 includes two spring elements 14, 34, each being shaped and sized for being positioned adjacent the respective gaps across a first side gap 140 between ends 130, 134, and second side gap 142 between ends 132, 136 of the respective frame members for each first and second side of the seat assembly 110. Each of the two spring elements 14, 34 is contained within a paired set of a first holder receptor 54 and a second holder receptor 74 (described below) that are separately attachable to each opposed end 18, 20 of each spring element.

Each spring element 14, 34 includes a mid-section 16, 36 that is aligned beside each respective gap 140, 142 between the respective backrest frame member and seat support frame member of the chair 10. Each spring element 14, 34 includes opposed ends 18, 20, with the first end 18 being oriented toward the back of the chair 10. The first end 18 includes a side surface 24 that is positioned generally beside backrest frame member 120. The first end 18 is extended a selected distance from gap 140 toward the back of the chair 10, and along the respective backrest frame member 120. The second end 20 of spring element 14 includes a side surface 26 that is positioned generally beside seat support frame 124, extending a selected distance from gap 140 toward the front of the chair 10. A typical selected distance that each opposed end 18, 20 extends from gap 140 is generally in the range of about 1.5 inch to about 2.0 inches, with one preferred selected distance being about 1.75 inch. The opposed ends 18, 20 of spring element 14 are fastened into each respective first holder receptor 54 and a second holder receptor 74 by a bolt or screw connector 28, inserted through spring element in proximity of end 18, and by bolt or screw connection 30, inserted through spring element in proximity of end 20.

The spring element 14, 34 is composed of stiff material, such as layered fiberglass, that is capable of being repetitively flexed and returned to the non-flexed, generally planar position for approximately 100,000 repetitions without failure. The resilient and stiff material of the spring element 14, 34 is produced by layering fiberglass in sheets to a specified depth and stiffness, then selectively making kerf cuts through each sheet to produce spring elements of the appropriate width, length, and depth. When each kerf cut is made during production of individual spring elements, material is lost with each kerf cut made, therefore it is beneficial to minimize the number of kerf cuts required to manufacture a set number of spring elements by increasing the width of each spring element. When a wide spring element is utilized that provides comparable resiliency and stiffness as compared to prior devices utilizing a greater number of narrower spring elements for each chair and seat assembly, then production costs are reduced and assembly of seat spring systems is simplified. One preferred embodiment of the present invention provides a spring element 14, 34 having the approximate dimensions of a width 22 of about 1.0 inch to about 1.25 inch, a length of about 3.25 inch to about 3.75 inch, and a depth in the range of about 0.25 inch to about 0.5 inch.

The second spring element 34 includes comparable dimensions as first spring element 14, with spring element 34 having a mid-section 36, with a first end 38, an opposed second end 40, and a width 42 of about 1.0 inch to about 1.25 inch. The second spring element 34 includes an inside side surface 44 of first end 38 that is positioned along the backrest frame member 122. The second end 40 includes an inside side surface 46 that is positioned generally beside seat support frame 126. A typical selected distance that each opposed end 38, 40 expends from gap 142 is generally in the range of about 1.5 inch to about 2.0 inches, with one preferred selected distance being about 1.75 inch. Second spring element 34 includes opposed ends 38, 40 that are fastened into each respective second holder receptor 54 and 74. Bolt or screw connector 48 is removably insertable through the spring element 34 in proximity of end 38, and bolt or screw connector 50 is removably insertable through the spring element 34 in proximity of end 40.

Figure 5:
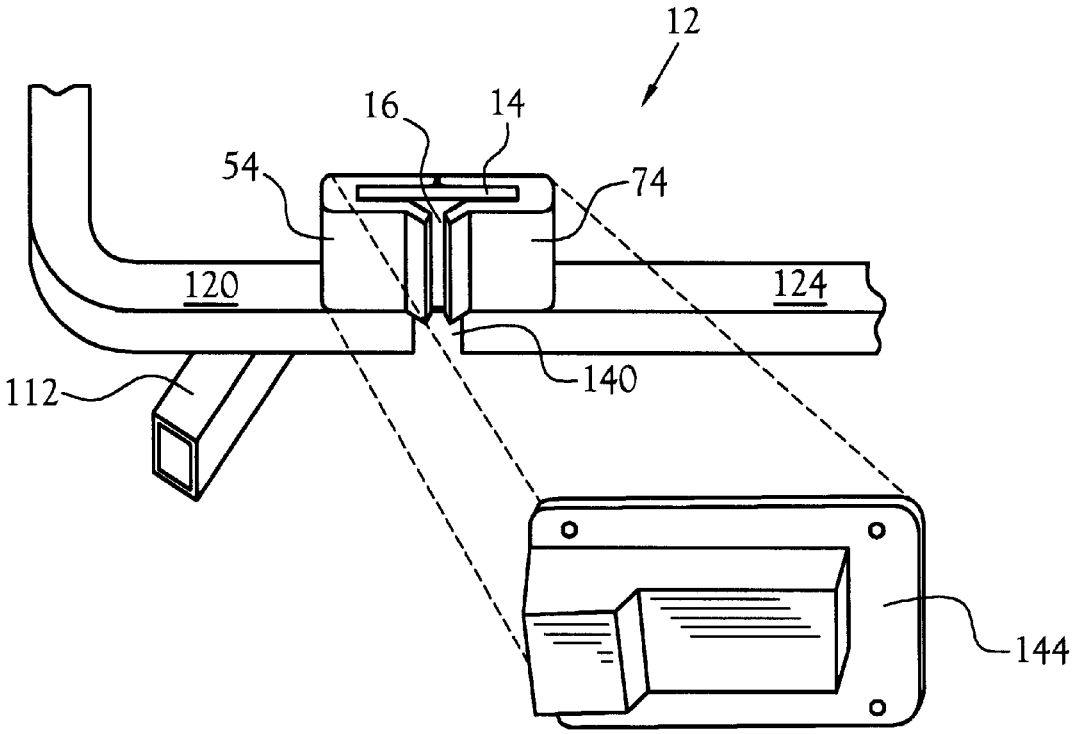
FIG. 5 is an enlarged underside perspective view of the left side of FIG. 4, illustrating one embodiment of the positioning of the elements of one seat spring assembly in relation to the backrest frame and seat support frame.

Each of the two spring elements is positioned and restrained by a pair of holder members that include a first holder receptor 54 and a second holder receptor 74. The paired holder receptors 54, 74 are each separately attachable by bolt connectors 28, 30 or 48, 50 to each opposed end of each respective spring element. As illustrated in FIGS. 1, 2, and 5, the first holder receptor 54 and second holder receptor 74 are elongated, each have a planar top portion 92 that is positioned upwards toward the seat assembly 110, and a bottom portion 94 that is positioned downwards toward the supporting floor for the chair 10. The description of a preferred embodiment for one pair WE of holder receptors 54, 74 of the seat spring system 12 is provided below, with the elements and orientation of elements applying equally to the holder receptors paired on an opposite side of the seat spring system 12 of the chair 10.

Each first holder receptor 54 is sized and shaped to enclose and contain each first end 18 of spring element 14. The holder receptors are elongated and include a continuous, single-layer wall being substantially U-shaped in cross-section. Each holder receptor is elongated and is substantially U-shaped in cross-section with a single layered wall of width in the range of about 1.25 inch to about 1.5 inch. The thickness of the wall of each holder receptor is determined by the weight capacity designed for the seat spring system 12. A holder receptor of the present invention is illustrated in FIGS. 1, 2, 5, and 6, and includes a closed end 64 for a first holder receptor 54, that encloses first end 18 of spring element 14. The U-shaped first holder receptor 54 includes an opening end 56 that is opposite the closed end 64. The opening end 56 includes a first projection end 58 that is angled at a selected angle 60 away from the generally planar surface 94 between closed end 64 and the angle 60. The opening end 56 is faced towards and in registry alignment with the second holder receptor 74 that is also substantially U-shaped in cross-section, having an opening end 76 faced toward the opening end 56. First holder receptor 54 includes a second end 62 that is adjacent the opening end 56, with the second end 62 not being angled in a preferred embodiment. In an alternate embodiment, second end 62 can be angled at the same or a different angle 60 than the first projection end 58. At one side of the closed end 64 facing the backrest frame member 120, a weld 138 or other durable connection is maintained between closed end 64 of first holder receptor 54 and an inwards faced side portion of backrest frame member 120 (see FIG. 6).

Second holder receptor 74 includes a second end 82 that is adjacent the opening end 76, with the second end 82 not being angled in a preferred embodiment. In an alternate embodiment, second end 82 can be angled at the same or a different angle 80 than the second projection end 78. In a preferred embodiment, first projection end 58 and second projection end 78 are angled toward each other when each U-shaped holder receptor 54, 74 are positioned to enclose and contain each respective end 18, 20 of spring element 14. A selected space in the range of about 0.125 inch to about 0.33 inch separates the projection end 58 and projection end 78 when each U-shaped holder receptor 54, 74 are positioned to enclose spring element ends 18, 20 (see FIGS. 1 and 6).

A similar sized or lesser sized space separates the second, non-angled end 62, from second, non-angled end 82, when each U-shaped holder receptor 54, 74 are positioned to enclose spring element ends 18, 20 (see FIG. 1 and FIG. 2). The space separating the end 62 from second end 82 is positioned adjacent and to the side of gap 140 between the backrest frame member 120 and the seat support frame member 124. At a side of the closed end 84 facing the seat support frame member 124, a weld 138 or other durable connection is maintained between closed end 84 of second holder receptor 74 and an inwards faced side portion of seat support frame member 124 (see FIG. 6). Therefore, the spring element mid-section 16, and the center line of the aligned first holder receptor 54 and second holder receptor 74, are positioned essentially off-center relative to the longitudinal center line of aligned backrest frame member 120 and seat support frame member 124. Comparable alignments and spatial orientations for the opposite side of the chair 10 and seat spring system 12 are maintained between the opposite side gap 142, and aligned holder receptors connected respectively to backrest frame member 122 and seat support frame member 126 on the opposite side of chair 10.

In operation, spring element 14 is flexed by the movement by the chair occupant of the backrest frame 118 and backrest frame members 120, 122, in relation to seat support frame 116 and seat support frame members 124, 126. The spring element 14 first end 18 is typically moved downward due to flex at the mid-section 16. As first end 18 moves downward along with backrest frame member 120, the opposed second end 20 is held in generally rigid alignment with seat support frame 124, therefore as first end 18 moves downward due to bending of spring element 14 at mid-section 16, first projection end 58 moves toward second projection end 78, as illustrated in FIG. 2. Contact is made in a flexed position 68 between projection ends 58, 78, therefore limiting the angular range of motion of the bending spring element 14 before breakage. With the flex of spring element 14 controlled by contact between projection ends 58, 78 in flexed position 68, the angular range of motion of the backrest frame is limited by the positioning of holder receptors 54, 74 which determines the selected space separation between each respective first projection end 58 and second projection end 78 of the holder receptors 54, 74.

Figure 6:
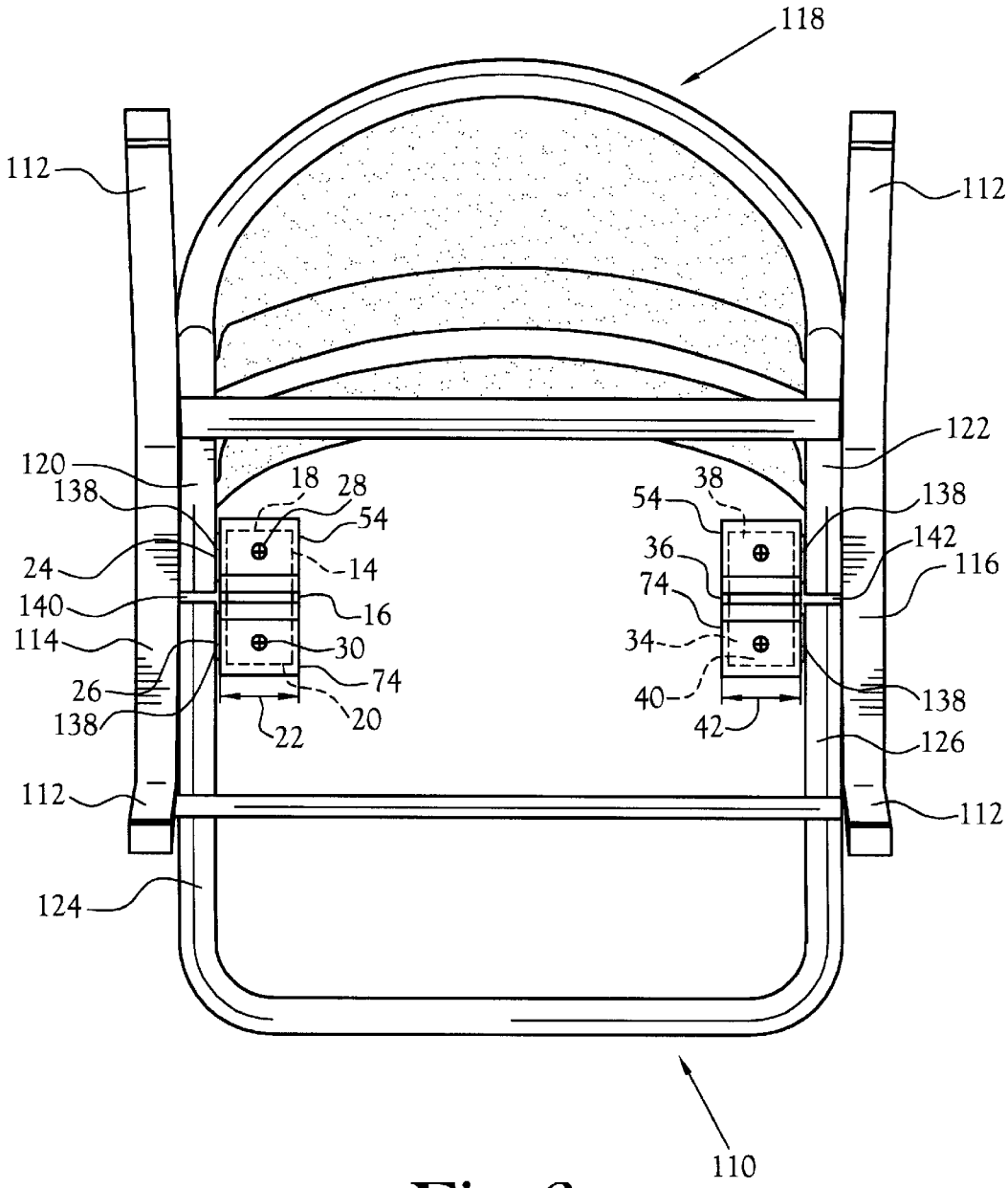
FIG. 6 is an underside view of the chair including the seat spring system, illustrating one embodiment of the positioning of a pair of seat spring assemblies connectable to the backrest frame and seat support frame.
Figure 7A:
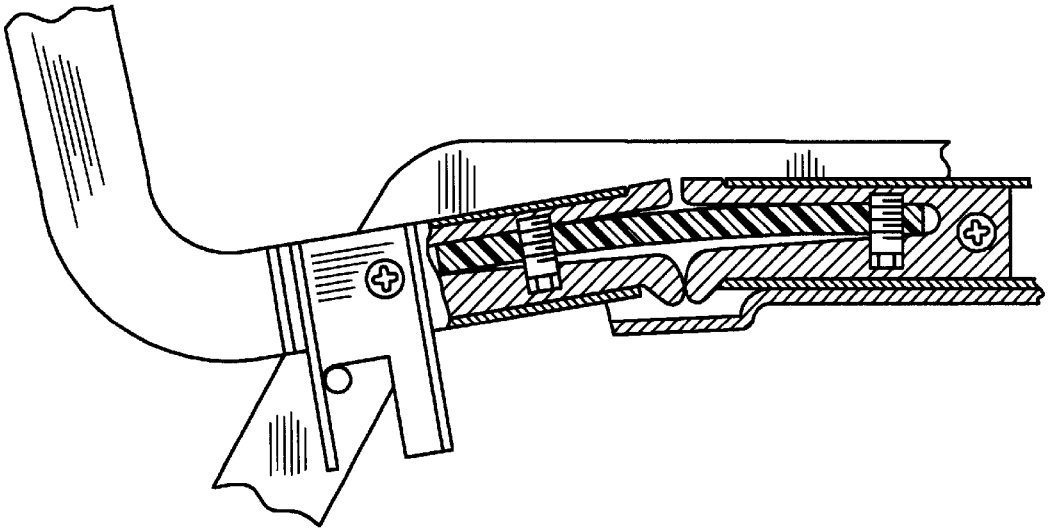
Fig.7a (PRIOR ART)
FIG. 7*a* is a side view of a prior art device in a flexed position for a flexible backrest assembly.
Figure 7B:
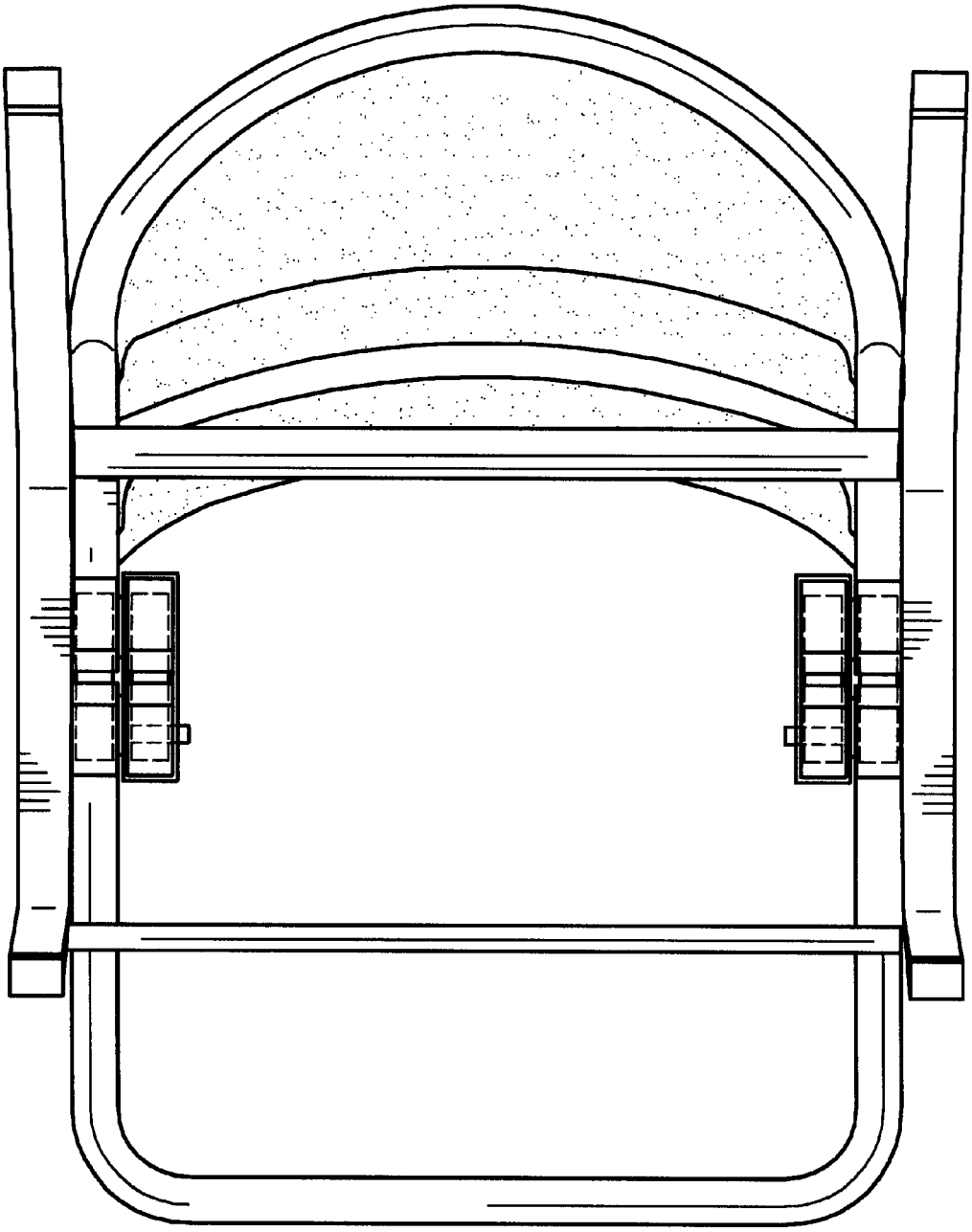
Fig.7b (PRIOR ART)
FIG. 7*b* is an enlarged underside perspective view of the left side of the prior art device of FIG. 7*a*.

The seat spring system 12 interconnects each side of the seat assembly 110 and backrest frame 118, by aligning backrest frame member 120 and seat support frame member 124 in registry with one another on one side of the chair 10, while gap 140 is maintained by interconnecting member 120 adjacent to a portion of first holder receptor 54, and interconnecting member 124 adjacent to a portion of second holder receptor 74, with spring element 14 being maintained in flexible and durable connection between frame members 120, 124 and across gap 140 (see FIGS. 1, 4, and 6). Structural support and continuity between each aligned frame member 120, 124 is maintained by each connecting bolt 28, 30 connecting the spring element 14 within each holder receptor 54, 74. A simplified spring support system is provided by the current invention that does not include two pairs of holder receptors for each side of the chair as required by prior devices, which also require up to four spring elements and eight holder receptors to be inserted into hollow frame members for control of flexible backrest frames as illustrated as prior art in FIG. 7.

Simplicity in production, assembly, and in operation is provided by the seat spring system 12 by utilizing U-shaped holder receptors having only a single layer wall thickness. The U-shaped holder receptors provide for restrained enclosure of each respective opposed end of the spring element. Each receptor having an opening defined by a first projection end and an adjacent second end of each receptor, the opening of each receptor being designed to removably receive one each of the opposed ends of the spring element, the opening of the first receptor being faced toward the opening of the second receptor. The first receptor having a first closed end opposite the first projection end and the second end, the second receptor having a second closed end opposite the first projection end and the second end of the second receptor, each opposed end of the spring element being positioned respectively internal of the first closed end and internal of the second closed end of the first receptor and the second receptor. The first receptor is connected in side-by-side configuration along the chair interior of one of the backrest frame members, with the second receptor connected in side-by-side configuration along the respective aligned seat support frame member.

With the spring element positioned within each single layer walled, U-shaped holder receptor, each spring element can be independently replaced by removing each restraining connector 28, 30 and inserting a spring element of similar shape and with more, or less structural stiffness.

As illustrated in Figures, a cover guard 144 can be installed over each pair of angled projection end 58, 78 positioned above gap 140 (see FIG. 5), and a similar cover 146 (not shown) can be installed over each pair of comparably angled projection ends installed above gap 142. Each cover 144, 146, provides protection from pinching of a seat occupant's fingers when the seat occupant moves the backrest frame 118, which moves each pair of projection ends 58, 78 together in an contacting position 68 as the first end 18 of each spring element 14, 34 is flexed downwardly (see FIG. 2).

An additional element of the seat spring system 12 includes a restraining bar 148 extending between the interior surfaces of each rear leg member 112 and across the rear of the chair beneath each backrest frame member 120, 122. The restraining bar 148 prevents over-bending of the backrest frame 118, and is an additional physical limitation operating in conjunction with each pair of projection ends 58, 78 to control and limit the angular range of motion due to over-flexing of the first end 18 of each spring element 14, 34. A restraining bar guide bracket 150 can be attached to the interior side of each leg member 112 (see FIG. 1) for protecting an occupant from having a hand pinched by the movement of restraining bar 148 when the backrest frame 118 is moved backwards.

An alternative embodiment provides a configuration of a chair seat assembly that includes a seat spring system for each side of the chair 10, the seat spring system having a spring element 14, 34 for each side of the seat assembly 110, with the first spring element 14 having opposed ends 18, 20 being restrained by two holder receptors 54, 74 being substantially U-shaped in cross-section. The spring element 14 and two holder receptors 54, 74 can be positioned in an aligned position underneath each aligned backrest frame member 120 and seat support frame member 124, with the mid-section 16 of the spring element 14 adjacent and beneath the gap 140 between aligned backrest frame member 120 and frame member 124. The first projection end 58 and second projection end 78 of each holder receptors 54, 74, are oriented to extend downward from the underneath position, thereby allowing first end 18 to move downward when flexed by the movement by the chair occupant of the backrest frame 118 and backrest frame members 120 in relation to seat support frame 116 and seat support frame member 124. In this alternate embodiment, as first end 18 moves downward along with backrest frame member 120, the opposed second end 20 is held in generally rigid alignment underneath the seat support frame 124. Therefore, first projection end 58 moves toward second projection end 78, and contact is made in a flexed position 68 between projection ends 58, 78, therefore limiting the angular range of motion of the bending spring element 14 before breakage. A comparably configured second spring element 34 can be positioned, with enclosed holder receptors underneath the backrest frame member 122 and seat support frame member 126. In order to limit the overall flex of spring element 14, as controlled by contact between projection ends 58, 78, the angular range of motion of the backrest frame is further limited by the positioning apart by a selected space between the holder receptors 54, 74, which determines the selected space separation between each respective first projection end 58 and second projection end 78. In addition, a restraining bar 148 is positioned extending between the interior surfaces of each rear leg member 112 and across the rear of the chair beneath each backrest frame member 120, 122. The restraining bar 148 prevents over-bending of backrest frame 118 and limits the overall flex of spring elements 14, 34. Each downward facing pair of projection ends 58, 78, are covered by guards 144 (FIG. 5), 146 (not shown), positioned respectively above gaps 140, 142.

Those skilled in the art will recognize that the additional alternative embodiments for the seat spring system having a spring element 14, 34 for each side of the seat assembly 110 can be provided. Each spring element and associated pairs of enclosing holder receptors can be positioned in an alternative position on an outer side position beside each respective aligned backrest frame member 120 and seat support frame member 124, and aligned backrest frame member 122 and seat support frame member 126. In the additional alternative embodiment, each mid-section 16, 36 of the respective spring elements 14, 34 are appropriately positioned adjacent the respective gaps 140, 142 between respective frame members.

Alternative embodiments can also include positioning the seat spring system having a spring element 14, 34 for each first and second side of the seat assembly 110 along the side or behind an upright, aligned and segmented backrest down tube (not shown), in an exterior upright position or an interior upright position next to respective gaps in each respective aligned backrest down tubes. A single spring element (not shown) can be aligned with and beside the gap between a singular upright, aligned and segmented backrest down tube with appropriate sizing and shaping of the width, depth, and length of the spring element for control of the angular range of motion of a singular backrest frame when moved relative to the seat support frame.

A further alternative embodiment can include positioning one spring element being sized and shaped to provide adequate stiffness, or a pair of stacked spring elements aligned with and removably attachable to the exterior upper 92 surface (see FIG. 1) of the aligned pair of holder receptors, with no spring element positioned within the U-shaped pair of holder receptors. A further alternative embodiment includes a layered holder receptor plate (not shown), paired with a similar layered holder receptor plate, with a opening between the paired, receptor plates, and having an appropriately sized and shaped spring element removably attachable to the exterior upper 92 surface of the receptor plates. The lower surface 94 of the singular layered holder receptor plates can include one projection attachment rising upwards at a selected angle from each surface 94, with each projection projecting towards the opposed projection attachment, to allow the projection attachment ends to meet and to limit the angular range of motion of the backrest frame when a first end of the spring element is flexed downwards by movement of the backrest support frame member attached to the first end of the layered holder receptor plate attached to the spring element. The spring element repetitively returns to an non-flexed, generally planar orientation, thus returning the backrest frame to an upright position.

Additional alternative embodiments can include utilizing comparable flexible materials known to those skilled in the art for layering with, or blending into each spring element, and sizing the spring element in a wider, thicker, and/or longer configuration that can be interchanged to fit within a pair of holder receptors for use to control larger sized chair occupants. The spring elements are replaceable without removing each pair of holder receptors from the position against the frame members by removing each of the bolt connectors 28, 30 through each opposed end of each spring element, removing the prior installed spring element, and replacing a new spring element with reattaching of the bolt connectors. Alternate connectors will be recognized by those skilled in the art to include an exterior clamp for each opposing end of each spring element, repositioned removable screws inserted through each opposing end of each spring element.

From the foregoing description, it will be recognized by those skilled in the art that an improved seat spring system offering advantages over the prior art is provided. Specifically, the seat spring system provides an effective adjustable chair seat back system including two spring elements of a sufficient width, depth, and length, with each spring element positioned along each side of the chair and positioned beside each aligned backrest frame member and seat support frame member. Each spring element is enclosed within a pair of holder receptors fabricated of steel or similar low cost materials. Use of steel for the holder receptors is less costly to manufacture by a factor of approximately five than prior uses of aluminum materials to encase the spring elements. Use of steel for two pair of holder receptors per each chair is less costly to manufacture and assemble than use of typically eight aluminum spring holders per chair for prior devices. Prior designs also required each spring element and aluminum spring holder to be encased within separate metal frame sections inserted into hollow chair frames. The improved spring elements and enclosing holder receptors are less in number than prior applications of similar spring element materials, and require less cutting of spring element materials which provide for less wastage by approximately 25% of spring element materials during each kerf cut made during the production process. The prior spring elements were smaller and required a significant additional number of kerf cuts with resulting wastage of spring element materials during production, to attain comparable control of the angular range of motion of the backrest frame of a chair.

In addition, the use of approximately two spring elements per chair back simplifies assembly, with each spring element is releasably attachable into the respective frame section without an additional aluminum or steel spring holder. The releasable attaching of each spring element allows for adjustment and/or removal of the spring elements for replacement with spring elements providing similar tensioning properties, or providing different tensioning properties. The prior applications of aluminum spring elements are typically riveted within each hollow, tubular frame section, with no allowance for disassembly or replacement of each spring element when broken or worn.

While a preferred embodiment is shown and described, it will be understood that it is not intended to limit the disclosure, but rather it is intended to cover all modifications and alternate methods falling within the spirit and the scope of the invention as defined in the appended claims.

What is claimed is:

1. A chair comprising a seat assembly which includes depending leg members and a support frame including a seat support frame having a pair of seat support frame members having ends, the support frame including a backrest frame having a pair of spaced apart backrest frame members upstanding relative to the pair of seat support frame members, the backrest frame members including a first backrest frame member and a second backrest frame member, each having an end extending beneath the seat support frame and arranged in registry with each respective end of the seat support frame members, the end of each backrest frame member having a width aligned with a width of each respective end of the seat support frame, the chair including a seat spring system to provide a flexible spring backrest for the chair, the seat spring system comprising:

each end of the pair of backrest frame members being positioned in spaced apart alignment and defining a gap between each respective seat support frame member end, said gap having no inserted spring element therein;

a spring element being shaped and sized for being positioned adjacent said gap between each backrest frame member end and each respective aligned seat support frame member end, said spring element having a mid-section being aligned adjacent with said gap, said spring element having opposed ends being extended a selected distance parallel to each of the backrest frame members and the respective aligned seat support frame member, said spring element being flexible in a longitudinal direction, said spring element having a width greater than the width of each of the backrest frame member end and the seat support frame end;

a first holder receptor and a second holder receptor being paired and separately attachable to each opposed end of said spring element, each of said first and second holder receptors being elongated and having a generally planar top section and a generally planar bottom section being attached by a closed end, each holder receptor being substantially U-shaped in cross-section, said first holder receptor having an opening end being faced towards and being aligned with said second holder having an opening end, said first holder receptor opening end being positioned apart a selected space from said second holder receptor opening end, said selected space being aligned adjacent each respective gap, said spring element being positioned therebetween said opening ends faced towards each other, whereby said spring element opposed ends being confined by said closed end, said top section, and said bottom section of each respective holder receptor; and said spring element mid-section being oriented in a parallel configuration adjacent said gap between the frame member ends, said first holder receptor closed end being secured to one of the pair of backrest frame members, said second holder receptor closed end being secured to the respective aligned seat support frame member, thereby said spring element being positioned essentially off-center relative to said longitudinal center line of each backrest frame member and the respective aligned seat support frame member, said spring element and attached holder receptors being positioned adjacent to, and not within each of the pair of backrest frame members and the respective aligned seat support frame member, whereby said spring element being flexed when each of the backrest frame members and the respective secured first holder receptor being moved by the chair occupant;

whereby said spring element mid-section being positioned adjacent said gap in the parallel configuration thereby provides controlled angular range of motion of the backrest frame when moved by the chair occupant relative to the seat support frame, said spring element concurrently provides structural continuity between each of the pair of backrest frame members and the respective aligned seat support frame member with said spring element opposed ends being confined by each respective first holder receptor and second holder receptor.

2. The chair of claim 1, wherein said spring element comprises:

a generally elongated rectangular length of substantially non-extensible flexible material, said flexible material having a width, a depth, and a generally planar length being contained within each respective first receptor holder and said second receptor holder except for a portion not contained within said respective receptor holders between said respective opening ends of said first receptor holder and said second holder receptor, said portion exposed being aligned adjacent said gap between the frame member ends;

said opposed ends of said spring element being releasably connectable within said first holder receptor and said second holder receptor by removable connectors; and said flexible material of said spring element being repetitively flexed in the longitudinal direction, and being returnable to the non-flexed planar length.

3. The chair of claim 2, wherein said first holder receptor and said second holder receptor further comprising:

each U-shaped holder receptor having a first projection end and a second end opposite said closed end, said first projection end being spaced apart from said second end across said opening end, said opening end of each holder receptor being sized to removably receive one each of the opposed ends of said spring element, said opening end of said first holder receptor being faced toward said opening end of said second holder receptor;

said opposed ends of said spring element being positioned respectively internal of said first holder receptor closed end and internal of said second holder receptor closed end;

said first holder receptor being connected proximate said closed end to one of the backrest frame members in side-by-side configuration along the backrest frame member;

said second holder receptor being connected proximate said closed end to one of the seat support frame members in side-by-side configuration along the respective aligned seat support frame member; and said first holder receptor opening end and said second holder receptor opening end having said spring element positioned therebetween, said mid-section of said spring element being oriented in side-by-side configuration with said gap between the first backrest frame member end and the respective aligned seat support frame end.

4. The chair of claim 3, wherein said first holder receptor and said second holder receptor further comprising:

said first projection end on each holder receptor opening end being angled outwardly from each respective opening end and being angled toward said opposed holder receptor, said angled projection end of said first holder receptor being oriented to contact said angled projection end of said second holder receptor, whereby when said angled projection ends contact each other due to said closed end of said first holder receptor being moved downward by the movement backwards of the backrest frame by the chair occupant, thereby the angular range of motion of the backrest frame being controlled; and said second end of said first holder receptor being generally aligned with an opposed second end of said second holder receptor, each second end being generally planar, said opposed second ends being separated by said selected space between each aligned pair of holder receptors.

5. The chair of claim 2, wherein said first holder receptor and said second holder receptor further comprising:

each U-shaped holder receptor having a first projection end and a second end opposite said closed end, said first projection end being spaced apart from said second end across said opening end, said opening end of each holder receptor being sized to removably receive one each of the opposed ends of said spring element, said opening end of said first holder receptor being faced toward said opening end of said second holder receptor;

said first holder receptor closed end opposite said first projection end and said second end, said second holder receptor closed end opposite said first projection end and said second end of said second holder receptor, each opposed end of said spring element being positioned respectively internal of said first holder receptor closed end and internal of said second holder receptor closed end;

said first holder receptor being connected proximate said closed end in parallel configuration below one of the pair of backrest frame members;

said second holder receptor being connected proximate said closed end in parallel configuration below the respective aligned seat support frame member; and said first holder receptor opening end and said second holder receptor opening end having said spring element positioned therebetween, said mid-section of said spring element being oriented in parallel configuration below said gap between the first backrest frame member end and the respective aligned seat support frame end.

6. The chair of claim 5, wherein said first holder receptor and said second holder receptor further comprising:

said first projection end on each holder receptor opening end being angled downwardly from each respective opening end and being angled toward said opposed holder receptor, said angled projection end of said first holder receptor being oriented to contact said angled projection end of said second holder receptor, whereby when said angled projection ends contact each other due to said closed end of said first holder receptor being moved downward by the movement backwards of the backrest frame by the chair occupant, thereby the angular range of motion of the backrest frame being controlled; and said second end of said first holder receptor being generally aligned with an opposed second end of said second holder receptor, each second end being generally planar, said opposed second ends being separated by said selected space between each aligned pair of holder receptors.

7. The chair of claim 1, wherein the backrest frame and the seat support frame include depending front leg members and rear-leg members, the rear leg members include a restraining bar connected therebetween the rear leg members and proximate to the backrest frame, whereby when said spring element is flexed by the chair occupant, the backrest frame is limited in extension by said restraining bar.

8. A chair including a back rest member and a seat member, comprising:

a seat assembly which includes depending leg members and a support frame including a seat support frame having a pair of seat support frame members having ends being extended upwardly at a back portion of the seat support frame, the support frame including a segmented backrest frame being supported by a pair of backrest frame members upstanding relative to the pair of seat support frame members, each of the backrest frame members having an end extending downwardly to the seat support frame and arranged in registry with each respective end of the seat support frame members, the chair including a seat spring system to provide a flexible spring backrest for the chair, the seat spring system comprising:

the ends of the pair of backrest frame members being positioned in spaced apart alignment and defining a gap between each respective seat support frame member end, said gap having no inserted spring element therein;

a spring element being shaped and sized for bridged extension adjacent said gap between the backrest frame member end and the seat support frame end, said spring element having a mid-section being aligned with said gap, said spring element having opposed ends being extended a selected distance on either side of said gap between the backrest frame member end and the seat support frame end, said spring element having a width greater than a width of each of the backrest frame member and the seat support frame end;

a first holder receptor and a second holder receptor, each holder receptor being U-shaped in cross-section for restrained enclosure of said opposed ends of said spring element, each holder receptor having an opening end defined by a first projection end opposite a second end, said opening end of each holder receptor being shaped to removably receive said spring element therebetween, said opening end of said first holder receptor being faced toward said opening end of said second holder receptor, said first holder receptor and said second holder receptor being shaped for restrained enclosure of each respective opposed end of said spring element, said first holder receptor having a first closed end, said second holder receptor having a second closed end, each closed end opposite said opening end of each holder receptor, each opposed end of said spring element being internal respectively said first closed end and said second closed end;

said first closed end of said first holder receptor being attached in side-by-side configuration proximate with the backrest frame member end;

said second closed end of said second holder receptor being attached in side-by-side configuration proximate with the seat support frame end; and said first holder receptor opening end and said second holder receptor opening end being each oriented in side-by-side configuration adjacent with the support frames, said spring element mid-section being aligned with said gap between the backrest frame member end and the seat support frame member end;

whereby said spring element mid-section being positioned adjacent said gap in the side-by-side configuration thereby provides controlled angular range of motion of the backrest frame when moved by the chair occupant relative to the seat support frame, said spring element concurrently provides structural continuity between each of the pair of backrest frame members and the respective aligned seat support frame member with said spring element opposed ends being confined by each respective first holder receptor and second holder receptor.

9. The chair of claim 8, wherein said first holder receptor and said second holder receptor further comprising:

each U-shaped holder receptor having a first projection end and a second end opposite said closed end, said first projection end being spaced apart from said second end across said opening end, said opening end of each holder receptor being sized to removably receive one each of the opposed ends of said spring element, said opening end of said first holder receptor being faced toward said opening end of said second holder receptor;

each opposed end of said spring element being positioned respectively internal of said first holder receptor closed end and internal of said second holder receptor closed end;

said first holder receptor being connected proximate said closed end in parallel configuration along one of the pair of backrest frame members;

said second holder receptor being connected proximate said closed end in parallel configuration along the respective aligned seat support frame member; and said first holder receptor opening end and said second holder receptor opening end having said spring element positioned therebetween, said mid-section of said spring element being oriented in parallel configuration beside said gap between the first backrest frame member end and the respective aligned seat support frame end.

10. The chair of claim 9, wherein said spring element comprises:

a generally elongated rectangular length of substantially non-extensible flexible material, said flexible material having a width, a depth, and a generally planar length being contained within each respective first receptor holder and said second receptor holder except for a portion not contained within said respective receptor holders between said respective opening ends of said first receptor holder and said second holder receptor, said portion exposed being aligned adjacent said gap between the frame member ends;

said opposed ends of said spring element being releasably connectable within said first holder receptor and said second holder receptor by removable connectors; and said flexible material of said spring element being repetitively flexed in the longitudinal direction, and being returnable to the non-flexed planar length.

11. The chair of claim 10, wherein said first holder receptor and said second holder receptor further comprising:

said first projection end on each holder receptor opening end being angled outwardly from each respective opening end and being angled toward said opposed holder receptor, said angled projection of said first holder receptor being oriented to contact said angled projection end of said second holder receptor, whereby when said angled projection ends contact each other due to said closed end of said first holder receptor being moved downward by the movement backwards of the backrest frame by the chair occupant, thereby the angular range of motion of the backrest frame being controlled; and a second end of said first holder receptor being generally aligned with an opposed second end of said second holder receptor, each second end being generally planar, said opposed second ends being separated by said selected space between each aligned pair of holder receptors.

12. The chair of claim 11, wherein the backrest frame and the seat support frame include depending front leg members and rear leg members, the rear leg members include a restraining bar connected therebetween the rear leg members and proximate to the backrest frame, whereby when said spring element is flexed by the chair occupant, the backrest frame is limited in extension by said restraining bar.

13. An improved chair including:

a seat assembly which includes depending leg members and a support frame including a seat support frame having a pair of seat support frame members having ends, the support frame including a segmented backrest frame being supported by a pair of backrest frame members upstanding relative to the pair of seat support frame members, each of the backrest frame members having an end extending beneath the seat support frame and arranged in registry with and in a spaced apart relationship with each respective end of the seat support frame members, said spaced apart relationship defining a gap between each respective end of the backrest frame in registry with each respective end of the seat support frame members, the chair including a seat spring system to provide a flexible spring backrest for the chair, wherein the improvement comprises a seat spring system including:

each end of the pair of backrest frame members being positioned in spaced apart alignment and defining a gap between each respective seat support frame member end, said gap having no inserted spring element therein;

a spring element being shaped and sized for bridged extension adjacent said gap between each backrest frame member end and each respective seat support frame member end, said spring element having a mid-section being aligned with said gap, said spring element having opposed ends being extended a selected distance on either side of said gap between the backrest frame member end and the seat support frame end, said spring element having a width greater than a width of each of the backrest frame member end and the seat support frame member end;

a first holder receptor and a second holder receptor, each holder receptor being U-shaped in cross-section for restrained enclosure of said opposed ends of said spring element, each holder receptor having an opening end defined by a first projection end opposite a second end, said opening end of each holder receptor being shaped to removably receive said spring element therebetween, said opening end of said first holder receptor being faced toward said opening end of said second holder receptor, said first holder receptor and said second holder receptor being shaped for restrained enclosure of each respective opposed end of said spring element, said first holder receptor having a first closed end, said second holder receptor having a second closed end, each closed end opposite said opening end of each holder receptor, each opposed end of said spring element being internal respectively said first closed end and said second closed end;

said first closed end of said first holder receptor being attached in parallel configuration proximate with the backrest frame member end;

said second closed end of said second holder receptor being attached in parallel configuration proximate with the seat support frame end; and said first holder receptor opening end and said second holder receptor opening end being each oriented in parallel configuration, said spring element mid-section being aligned adjacent with said gap between the backrest frame member end and the seat support frame end;

whereby said spring element mid-section being positioned adjacent said gap in the parallel configuration thereby provides controlled angular range of motion of the backrest frame when moved by the chair occupant relative to the seat support frame, said spring element concurrently provides structural continuity between each of the pair of backrest frame members and the respective aligned seat support frame member with said spring element opposed ends being confined by each respective first holder receptor and second holder receptor.

14. The improved chair of claim 13, wherein said spring element comprising:

a generally elongated rectangular length of substantially non-extensible flexible material, said flexible material having a width, a depth, and a generally planar length being contained within each respective first receptor holder and said second receptor holder except for a portion not contained within said respective receptor holders between said respective opening ends of said first receptor holder and said second holder receptor, said portion exposed being aligned adjacent said gap between the frame member ends;

said opposed ends of said spring element being releasably connectable within said first holder receptor and said second holder receptor by removable connectors; and said flexible material of said spring element being capable of being repetitively flexed in the longitudinal direction, and being returnable to the non-flexed planar length.

15. The improved chair of claim 14, wherein said first holder receptor and said second holder receptor further comprising:

said first projection end on each holder receptor opening end being angled outwardly from each respective opening end and being angled toward said opposed holder receptor, said angled projection of said first holder receptor being oriented to contact said angled projection end of said second holder receptor, whereby when said angled projection ends contact each other due to said closed end of said first holder receptor being moved downwardly by the movement backwards of the backrest frame by the chair occupant, thereby the angular range of motion of the backrest frame being controlled; and a second end of said first holder receptor being generally aligned with an opposed second end of said second holder receptor, each second end being generally planar, said opposed second ends being separated by said selected space between each aligned pair of holder receptors.

16. The improved chair of claim 15, wherein said first holder receptor and said second holder receptor further comprising:

said first holder receptor being connected proximate said closed end to one of the pair of the backrest frame members in side-by-side configuration along one of the pair of backrest frame members;

said second holder receptor being connected proximate said closed end to the respective aligned seat support frame member in side-by-side configuration along the respective aligned seat support frame member; and said first holder receptor opening end and said second holder receptor opening end having said spring element positioned therebetween, said mid-section of said spring element being oriented in side-by-side configuration beside said gap between the backrest frame member end and the seat support frame end.

17. The improved chair of claim 15, wherein said first holder receptor and said second holder receptor further comprising:

said first holder receptor being connected proximate said closed end to one of the pair of the backrest frame members in parallel configuration below one of the pair of backrest frame members;

said second holder receptor being connected proximate said closed end to the respective aligned seat support frame member in parallel configuration below the respective aligned seat support frame member; and said first holder receptor opening end and said second holder receptor opening end having said spring element positioned therebetween, said mid-section of said spring element being oriented in parallel configuration below said gap between the backrest frame member end and the seat support frame end.

18. A chair having a backrest frame member and a seat assembly comprising:

said seat assembly including a seat frame residing in a generally horizontal plane, said seat assembly having front and rear edges and having first and second side seat members extending from said front edge toward said rear edge, said first and second side seat members having ends terminating at a location intermediate said front and rear edges of said seat assembly;

said backrest frame member including first and second side frame members residing in a generally upright plane, said first and second side frame members having respective first and second lower leg members residing in a generally horizontal plane, said first and second lower leg members having terminal ends positioned proximal to, and aligned in a spaced apart relationship to, respective ends of said first and second side seat members at a location intermediate said front and rear edges of said seat assembly, said spaced apart relationship defining a gap between each of said terminal ends of said first and second lower leg members of said backrest frame member and said respective ends of said first and second side seat members, said gap having no inserted spring member therein, a first elongated connector disposed alongside said terminal end of said first lower leg member of said backrest frame member and said end of said first side seat member, and adjacent said gap, said first elongated connector including a first U-shaped member having first and second legs projecting from a closed end of said U-shaped member and extending generally parallel along an inwardly facing side of said end of said first side seat member of said seat assembly and terminating substantially co-terminal and adjacent with said gap between said end of said first side seat member and said terminal end of said first lower leg member of said backrest frame member, said first elongated connector including a second U-shaped member having first and second legs projecting from a closed end of said member and extending generally parallel along an inwardly facing side of the terminal end of said first backrest leg member and terminating in spaced apart relationship substantially adjacent said between said first side seat support member and said first backrest member, the terminal ends of said first and second U-shaped members being disposed substantially collinear with and spaced apart from one another laterally inward of said seat assembly to define a laterally spaced continuation of said space defined between said gap between said first side seat member and said backrest first lower leg member, a planar spring member having first and second opposite ends, said spring member having one of its ends interposed between said legs of said first U-shaped member and anchored adjacent said closed end of said first U-shaped member and its opposite end interposed between said legs of said second U-shaped member and anchored adjacent said closed end of said second U-shaped member extending fully across said gap between said terminal ends of said first U-shaped member and said second U-shaped member, said spring member having a width greater than a width of each of said terminal ends of said first and second lower leg members of said backrest frame member and said respective ends of said first and second side seat members, means for securing said closed end of said first U-shaped member to said end of said first side seat support member, means for securing said closed end of said second U-shaped member to said terminal end of said first backrest lower leg member, thereby interlocking said end of said first side seat support member and said terminal end of said first lower leg member together in aligned spaced-apart relationship and providing for movement of said backrest first lower leg member about a pivot axis lying within the plane of said spring member, and a second elongated connector which is substantially a mirror image of said first elongated connector and which is disposed alongside said end of said second side seat member and said terminal end of said second back rest lower leg member, said second elongated connector having a second planar spring member therein, said second elongated connector connected at a location alongside and adjacent said gap between said end of said second side seat member and said terminal end of said second lower leg member, said second elongated connector disposed directly opposite said first elongated connector, whereby said first planar spring member and said second planar spring member are limited in depth and width only by the length of the legs of said first and second U-shaped members of respective elongated connectors and the spatial separation of said first and second side seat members.

19. The chair of claim 18, wherein said planar spring member comprises:

a generally elongated rectangular length of substantially non-extensible resilient material, said resilient material having a width, a depth, and a generally planar length being contained within each respective first elongated connector and said second elongated connector except for a mid-portion not contained within said respective elongated connectors between said respective first and second legs of said first elongated connector and said second elongated connector, said portion exposed being aligned adjacent said gap between said respective side frame members and said lower leg members of said backrest frame member;

said opposed ends of said spring member being releasably connectable within said first elongated connector and said second elongated connector by removable connectors.

20. The chair of claim 19, wherein said seat assembly further includes first and second support legs for support of said seat assembly above a supporting surface, said first and second support legs having respective first and second seat side support members disposed adjacent respective ones of said first and second lower leg members of said first and second side frame members of said backrest frame member, said first and second seat side support members further disposed adjacent respective ones of said first and second side seat members of said seat assembly.

* * * * *